US008959723B2

(12) United States Patent
Gennrich et al.

(10) Patent No.: US 8,959,723 B2
(45) Date of Patent: Feb. 24, 2015

(54) ADJUSTABLE AND VENTED APPAREL CLOSURE ASSEMBLY

(75) Inventors: David J. Gennrich, Fitchburg, WI (US); Randall S. Koplin, Sun Prairie, WI (US); Eric W. Gobrecht, Madison, WI (US); Daniel R. Nett, Sun Prairie, WI (US)

(73) Assignee: Trek Bicycle Corporation, Waterloo, WI (US)

( * ) Notice: Subject to any disclaimer, the term of this patent is extended or adjusted under 35 U.S.C. 154(b) by 603 days.

(21) Appl. No.: 12/982,514

(22) Filed: Dec. 30, 2010

(65) Prior Publication Data

US 2012/0167281 A1 Jul. 5, 2012

(51) Int. Cl.

| | |
|---|---|
| ***A42B 3/04*** | (2006.01) |
| ***A42B 3/00*** | (2006.01) |
| ***A42B 3/08*** | (2006.01) |
| ***A43B 5/00*** | (2006.01) |
| ***A42B 3/14*** | (2006.01) |
| ***A43C 11/16*** | (2006.01) |

(52) U.S. Cl.

CPC ..... *A42B 3/145* (2013.01); *A43C 11/165* (2013.01)

USPC ..... 24/68 B; 24/68 SK; 24/71.1; 24/712.9; 36/114; 2/410; 2/417; 2/418; 2/421

(58) Field of Classification Search

USPC ..... 242/388.8, 396.1; 36/50.1, 50.5, 114; 2/410, 414, 417, 418, 421; 24/68 B, 24/68 R, 68 SK, 71.1, 712.9

See application file for complete search history.

(56) References Cited

U.S. PATENT DOCUMENTS

| | | | | | |
|---|---|---|---|---|---|
| 2,926,406 | A | * | 3/1960 | Zahnor et al. | 24/68 B |
| 3,214,809 | A | * | 11/1965 | Zahnor | 24/68 B |
| 3,325,824 | A | * | 6/1967 | Donegan | 2/8.1 |
| 3,668,791 | A | * | 6/1972 | Salzman et al. | 36/50.1 |
| 3,729,779 | A | * | 5/1973 | Porth | 24/68 SK |
| 4,633,599 | A | * | 1/1987 | Morell et al. | 242/388.1 |
| 4,660,300 | A | * | 4/1987 | Morell et al. | 36/118.1 |
| 4,961,544 | A | * | 10/1990 | Bidoia | 242/395 |
| 5,745,959 | A | * | 5/1998 | Dodge | 24/68 SK |
| 5,887,288 | A | | 3/1999 | Arney et al. | |
| 5,934,599 | A | | 8/1999 | Hammerslag | |
| 5,950,245 | A | | 9/1999 | Binduga | |
| 5,983,405 | A | | 11/1999 | Casale | |
| 6,108,824 | A | | 8/2000 | Fournier et al. | |

(Continued)

FOREIGN PATENT DOCUMENTS

| | | | |
|---|---|---|---|
| EP | 0832572 | B1 | 3/2002 |
| WO | WO 2006/050266 | A2 | 5/2006 |

(Continued)

*Primary Examiner* — Robert J Sandy
*Assistant Examiner* — Louis Mercado

(57) ABSTRACT

A closure assembly that is infinitely adjustable within an operating range of the closure assembly and includes a vent port therethrough. The closure assembly includes a housing and an operator that rotationally cooperates with the housing. A flexible member is movably supported by the housing and cooperates with the operator so that manipulation of the operator alters the amount of the flexible member that extends beyond the housing. A biasing means cooperates with the operator and interacts with the housing to maintain a desired orientation of the operator, and thereby a desired orientation of the flexible member, relative to the housing to define a shape of a closure of the item of apparel. A vent port is formed through the housing and the operator and mitigates heat collection therebehind.

18 Claims, 8 Drawing Sheets

(56) References Cited

U.S. PATENT DOCUMENTS

| | | | | |
|---|---|---|---|---|
| 6,202,953 | B1 | 3/2001 | Hammerslag | |
| 6,226,802 | B1 | 5/2001 | Sasaki et al. | |
| 6,260,197 | B1 | 7/2001 | Hoogewind | |
| 6,289,558 | B1 | 9/2001 | Hammerslag | |
| 6,401,261 | B1 | 6/2002 | Arney et al. | |
| 6,425,142 | B2 | 7/2002 | Sasaki et al. | |
| 6,966,075 | B2 | 11/2005 | Racine | |
| 7,000,262 | B2 | 2/2006 | Bielefeld | |
| 7,043,772 | B2 | 5/2006 | Bielefeld et al. | |
| 7,089,603 | B2 | 8/2006 | Ketterer et al. | |
| 7,174,575 | B1 | 2/2007 | Scherer | |
| 7,178,175 | B2 | 2/2007 | Rogers et al. | |
| 7,222,374 | B2 | 5/2007 | Musal et al. | |
| 7,249,727 | B2 | 7/2007 | Kovacevich et al. | |
| 7,252,259 | B2 | 8/2007 | Kovacevich et al. | |
| 7,296,305 | B2 | 11/2007 | Ketterer et al. | |
| 7,367,522 | B2 * | 5/2008 | Chen | 242/378.1 |
| 7,516,914 | B2 | 4/2009 | Kovacevich et al. | |
| 7,591,050 | B2 | 9/2009 | Hammerslag | |
| 7,634,820 | B2 | 12/2009 | Rogers et al. | |
| 7,694,354 | B2 | 4/2010 | Philpott et al. | |
| 7,950,112 | B2 * | 5/2011 | Hammerslag et al. | 24/68 SK |
| 7,954,204 | B2 * | 6/2011 | Hammerslag et al. | 24/68 SK |
| 2002/0095750 | A1 * | 7/2002 | Hammerslag | 24/68 SK |
| 2005/0204456 | A1 | 9/2005 | Piper et al. | |
| 2005/0262619 | A1 | 12/2005 | Musal et al. | |
| 2006/0015986 | A1 | 1/2006 | Bielefeld | |
| 2006/0053532 | A1 | 3/2006 | Ketterer et al. | |
| 2006/0156517 | A1 | 7/2006 | Hammerslag et al. | |
| 2006/0185357 | A1 | 8/2006 | Kovacevich et al. | |
| 2006/0195974 | A1 | 9/2006 | Burkhart et al. | |
| 2007/0039085 | A1 | 2/2007 | Kovacevich et al. | |
| 2007/0079429 | A1 | 4/2007 | Pilon et al. | |
| 2007/0169251 | A1 | 7/2007 | Rogers et al. | |
| 2007/0245468 | A1 | 10/2007 | Butler | |
| 2007/0250986 | A1 | 11/2007 | Zuber | |
| 2008/0060167 | A1 | 3/2008 | Hammerslag et al. | |
| 2008/0060168 | A1 | 3/2008 | Hammerslag et al. | |
| 2008/0066345 | A1 | 3/2008 | Hammerslag et al. | |
| 2008/0066346 | A1 | 3/2008 | Hammerslag et al. | |
| 2008/0083135 | A1 | 4/2008 | Hammerslag et al. | |
| 2008/0156924 | A1 | 7/2008 | Kovacevich et al. | |
| 2008/0223972 | A1 | 9/2008 | Kovacevich et al. | |
| 2008/0276354 | A1 | 11/2008 | Stokes et al. | |
| 2008/0289085 | A1 | 11/2008 | Bryant et al. | |
| 2009/0031482 | A1 | 2/2009 | Stokes et al. | |
| 2009/0184189 | A1 | 7/2009 | Soderberg et al. | |
| 2010/0050324 | A1 | 3/2010 | Musal | |
| 2010/0139057 | A1 | 6/2010 | Soderberg et al. | |

FOREIGN PATENT DOCUMENTS

| | | | |
|---|---|---|---|
| WO | WO 2006/091976 | C1 | 8/2006 |
| WO | WO 2010/059989 | A2 | 5/2010 |

* cited by examiner

ADJUSTABLE AND VENTED APPAREL CLOSURE ASSEMBLY

BACKGROUND OF THE INVENTION

The present invention relates to an adjustable apparel closure assembly, and more specifically, to an apparel closure system that is infinitely adjustable within an operating range of the closure assembly. Another aspect of the invention relates to allowing air to circulate around as well as through the closure assembly to improve cooling of the user.

Many items of apparel are provided with closure assemblies that allow the user to conveniently place the apparel about a body structure and then manipulate the closure assembly so that the apparel can be snuggly and securing positioned about the anatomy of the wearer. Although zipper structures are common for many torso covering apparel, zippers are not particularly conducive to all apparel and/or all anatomical coverings. For instance, zippers commonly require visual inspection of the respective portions of the zipper to allow alignment for proper operation of the zipper. Commonly, such systems also require two-handed manipulation of respective sides of the item of apparel.

Headgear and shoes are two items of apparel that do not lend themselves to zipper closure assemblies. Commonly, and particularly applicable to the use of bicycles, such helmets include a closure assembly that is positioned at the back of the head when the headgear is positioned about the head of the wearer. Many such closure assemblies are constructed for single handled and out of sight operation but such systems are not without their respective drawbacks.

Many helmets, like constructions hard-hats and bicycle helmets include an operator that is turned by the user in a clockwise and counterclockwise direction to tighten and/or loosen the helmet relative to the user. Most such systems include a rack and pinion arrangement that alters the closure associated with the helmet. However, such rack and pinion systems allow for only limited incremental adjustment of the size of the closure. Although such systems tolerate a range of sizes associated with a given user, the incremental nature of the operation of the tightening mechanism leaves many users tolerating a closure pressure that is undesirably loose and/or tight. Accordingly, there is a need for an apparel closure system wherein the shape of the closure is infinitely adjustable within an operating range of the closure assembly.

Another drawback of such closure systems is the generally large footprint associated with the closure system. The closure assembly associated with most headgear includes a generally solid bodied base that rests against the head or other adjacent anatomy of a user. The solid bodied nature of such closure systems do not lend themselves to desirable ventilation of the wearer during the strenuous activities commonly associated with wearing such apparel. The footprint of such closure systems is generally controlled by the size of the rack and pinion system and the structure intended to interact therewith. Although reducing the size of the rack and pinion system would reduce the footprint associated with the closure system, such modification sacrifices the operational integrity of the closure assembly. Accordingly, there is also a need for an adjustable closure assembly that allows better ventilation of the wearer.

As mentioned above, helmets are one environment requiring an improved closure assembly. Shoes, and particularly bicycle shoes, are another environment that could be improved by addressing the shortcomings discussed above. Many users desire to quickly and repeatedly orient and secure a shoe to a respective foot. Single handed operation is another important consideration to any such closure assembly. Particularly during use of a bicycle, due to the interaction with the handlebar, a rider can only have one hand free to adjust a closure of an item of apparel without suspending operation of the bicycle. Adjusting a shoe closure device can often occur during riding to address swelling of the foot.

Like bicycle helmets, many shoe closure devices are also solid bodied assemblies that include adjustable members that are secured to the opposite lateral sides of the upper of a shoe. The compression of the closure assembly about the foot detracts from desirable venting of the foot. Although many manufactures have addressed such a shortcoming by forming portions of the shoe structure from vented materials, such materials do not resolve the inadequate venting attributable to the closure assembly.

Accordingly, regardless of the particular item of apparel, there is a need for an apparel closure assembly that is infinitely adjustable within an operating range of the closure assembly. There is a further need for an apparel closure assembly having a construction that reduces the detrimental heating affects commonly attributable to the solid bodied shape of the closure assembly.

SUMMARY OF THE INVENTION

The present invention provides an apparel closure assembly that addresses one or more of the shortcoming discussed above. According to one aspect of the invention, a closure assembly is disclosed that includes a ventilation port therethrough. The closure assembly includes a housing and an operator that rotationally cooperates with the housing. A flexible member is movably supported relative to the housing and cooperates with the operator so that manipulation of the operator alters the amount of the flexible member that extends beyond the housing. A biasing means, such as a torsion spring, cooperates with the operator and interacts with the housing to maintain a desired orientation of the operator, and thereby a desired orientation of the flexible member, relative to the housing to define a shape of a closure of the item of apparel. Another aspect of the invention discloses a vent port that is formed through the closure assembly to mitigate the collection of heat between the closure assembly and the wearer.

Another aspect of invention useable with one or more of the above aspects discloses an apparel closure assembly that includes a housing and a flexible member that extends beyond the housing and engages an item of apparel. A spring is disposed in the housing and an operator is rotatably attached with the housing and engaged by the spring. The operator is configured to interact with the spring and the flexible member so that rotation of the operator in a first direction allows the flexible member to dispense from the housing and rotation of the operator in a second direction retracts the flexible member into the housing. The spring retains the position of the flexible member relative to the housing.

Another aspect of the invention that can be combined or used with one or more of the aspects discussed above discloses an adjustable closure assembly that includes a base member, a drum assembly that extends through the base member, and a handle that is supported by the drum assembly and rotationally connected to the base member. A closure member is disposed between the base member, the drum assembly, and the handle and a spring is positioned between the handle and the drum assembly. The spring is biased from a rest position to constrict about the drum assembly and is positioned to interact with the handle so that rotation of the handle in a first direction biases the spring out of constriction about the drum assembly and rotation of the handle in a second direction rotates the closure member with respect to the base member.

Another aspect of the invention that is combinable with one or more of the aspects or features above discloses a method of altering a tension of a closure of an item of apparel. A first side of a flexible member is secured to a first side of a closure and a second side of the flexible member is secured to a second side of the closure. Manipulation of a handle alters a tension of the flexible member about the closure and manipulating the shape of a torsion spring in response to manipulation of the handle in a first direction relieves tension of the flexible member and the tension on the flexible member is increased during manipulation of the handle in a second direction opposite the first direction.

Another aspect of the invention that is combinable with one or more of the aspects or features above discloses an adjustable closure assembly having a housing and a drum that is attached to the housing. A flexible member is supported by the drum and is rotationally positionable relative to the housing. A handle is attached to the drum and positioned to interact with the flexible member to alter a shape of a closure of an item of apparel. A passage is formed through the housing and exposes a portion of a wearer that is within a boundary of the housing to atmosphere.

Preferably, the closure assemblies and method of altering a tension of a closure disclosed in the above aspects is applicable to various items of apparel including but not limited to bicycle helmets and bicycle shoes.

In another preferred aspect usable with one or more of the above aspects, a vent is formed through the closure assembly and exposes a portion of the wearer that is internal to an exterior edge of the closure assembly directly to atmosphere. The vent reduces the detrimental effects commonly associated with fully covering that portion of the anatomy that underlies the footprint of similar but solid bodied closure assemblies.

These and various other aspects and features of the present invention will be better appreciated and understood when considered in conjunction with the following detailed description and the accompanying drawings. It should be understood that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate one preferred embodiment presently contemplated for carrying out the invention. In the drawings.

Figure 1:
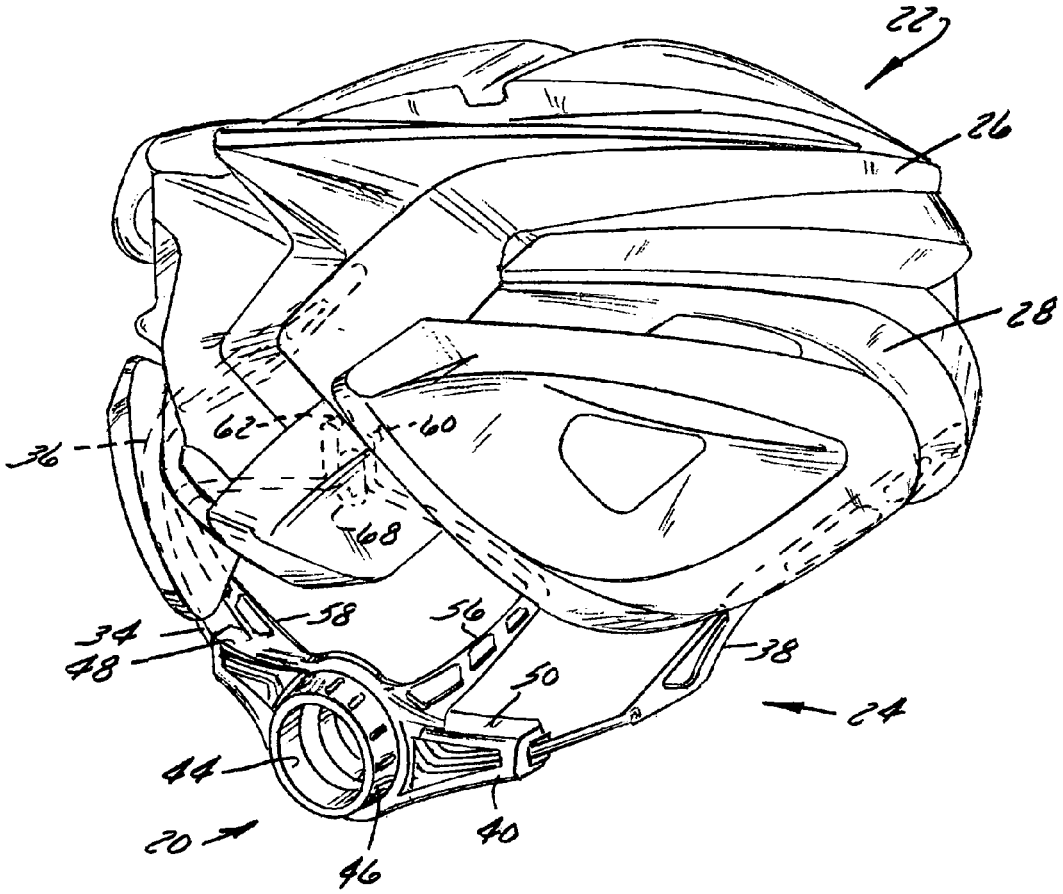
FIG. 1 is a rear perspective view of a bicycle helmet equipped with a closure assembly according to the present invention.
Figure 2:
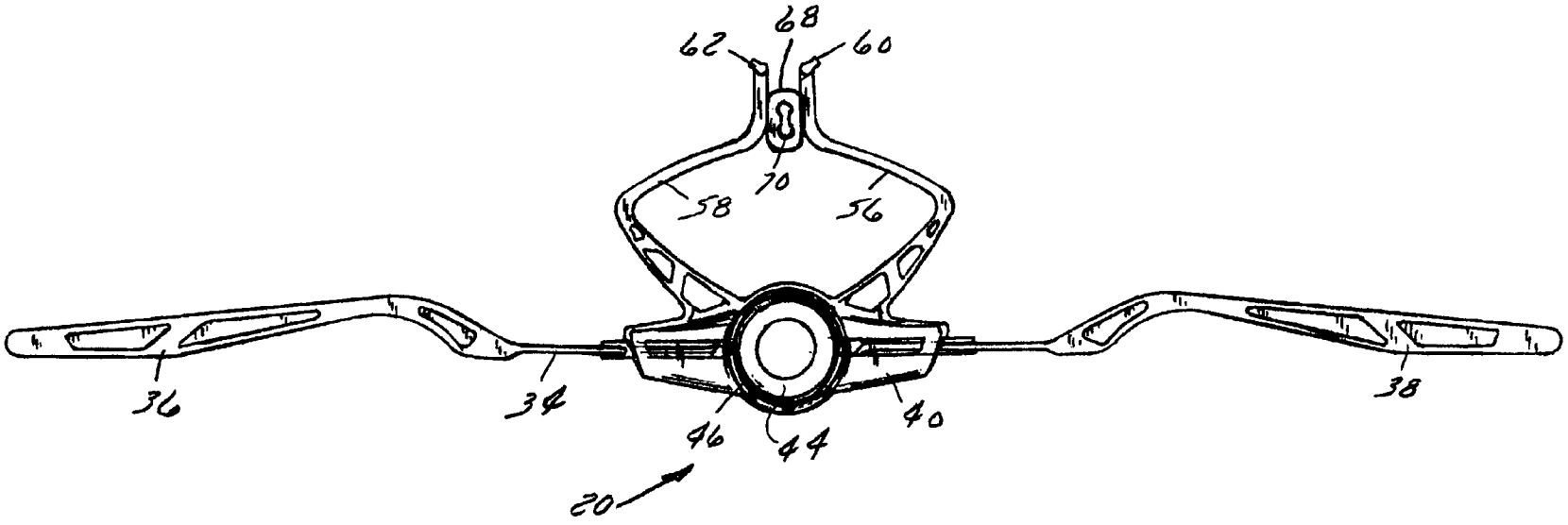
FIG. 2 is a rear elevational view of the closure assembly shown in FIG. 1 and removed from the helmet.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION OF THE PREFERRED EMBODIMENT

FIG. 1 shows a closure assembly 20 according to the present invention engaged with an exemplary helmet 22 such as a bicycle helmet. Helmet 22 includes a downward facing opening 24 that is generally defined by a body 26 of helmet 22. Body 26 includes a number of channels 28 and openings 30 that are shaped and positioned to facilitate the flow of air over and around the head of the wearer both over and under the helmet. Opening 24 is generally shaped to non-interferingly accept the crown or top portion of a wearer's head. One or more straps or a net (not shown) are commonly secured to the interior portion of helmet 22 and extend downward therefrom. Commonly such systems include a chin strap assembly that is to be secured generally below the chin of a wearer.

Although closure assembly 20 is shown as being configured to cooperate with a bicycle helmet, it is appreciated that closure assembly 20 can be provided in a number of form factors to tolerate incorporation into other items of apparel. That is, it is envisioned that closure assembly 20 can also be configured to provide a convenient, secure, and repeatable closure assembly for closing the throat or ankle opening commonly associated with bicycle shoes or the like.

As shown in FIGS. 1-5, closure assembly 20 includes a flexible member 34 having a first arm portion 36 and a second arm portion 38 that extend along the lateral sides of helmet 22. Arms 36, 38 are generally configured to cooperate with the straps or net assembly associated with helmet 22 such that manipulation of closure assembly 20 alters the length of arms 36, 38 so as to secure the helmet about the wearer's head. It is appreciated that closure assembly 20 could include flexible member having shapes other than those shown and/or be provided as a cable that could conveniently tolerate various contours of a particular item of apparel. It is further appreciated that, depending in part on the configuration of helmet 22, arms 36, 38 could be directly secured to the helmet and/or to supplemental strapping such as a chin strap as discussed above.

Closure assembly 20 includes a housing 40 and an operator or handle 46 that is rotationally secured to housing 40. Housing 40 includes an optional first guide 48 and an optional second guide 50 that extend an opposite forward lateral directions from housing 40 and toward the opposite lateral sides of helmet 22. Understandably, guides 48, 50 may have other shapes and/or simply be omitted for other uses of closure assembly 20 and/or use of closure assembly 20 with other helmet configurations.

Arm portions 36, 38 of flexible member 34 movably, and preferably slidably, cooperate with guides 48, 50. Housing 40 also includes a pair of optional supports 56, 58 that extend in a generally upward and slightly forward direction relative to handle 46. A distal end 60, 62 of each support 56, 58 is constructed to cooperate with an interior surface of helmet 22 so as to positionally orient closure assembly 20 relative thereto. An optional flange 68 is disposed between distal ends 60, 62 of supports 56, 58. An opening 70 is formed through flange 68 and configured to cooperate with a boss or other projection, and/or fastener, to provide a more robust securing arrangement of closure assembly 20 with helmet 22.

Figure 3:
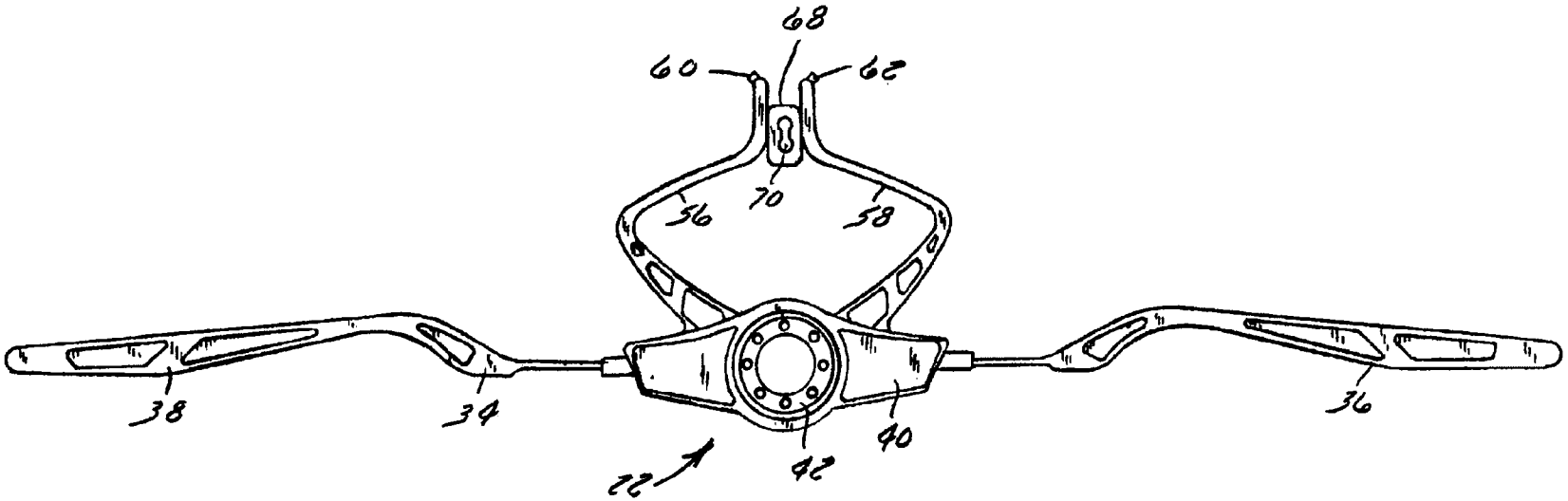
FIG. 3 is a front elevation view of the closure assembly shown in FIG. 2.
Figure 4:
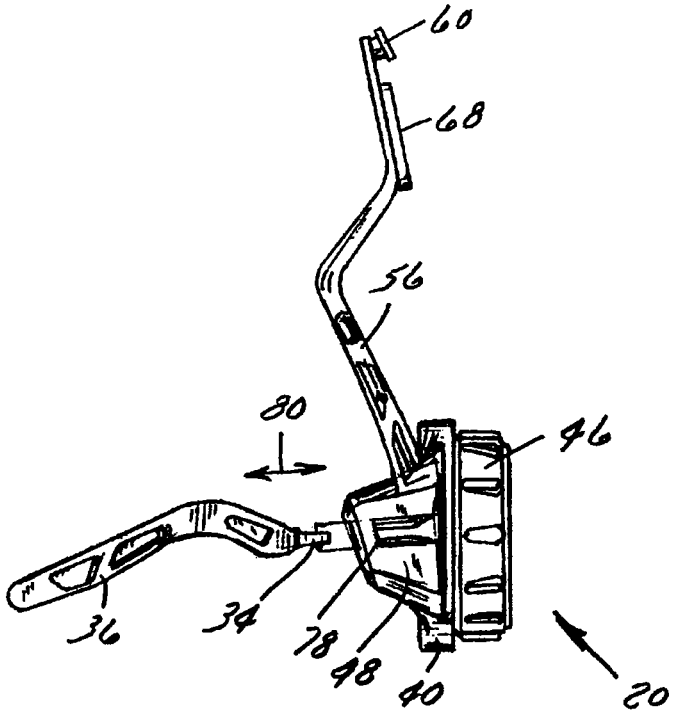
FIG. 4 is side elevation view of the closure assembly shown in FIG. 2.
Figure 5:
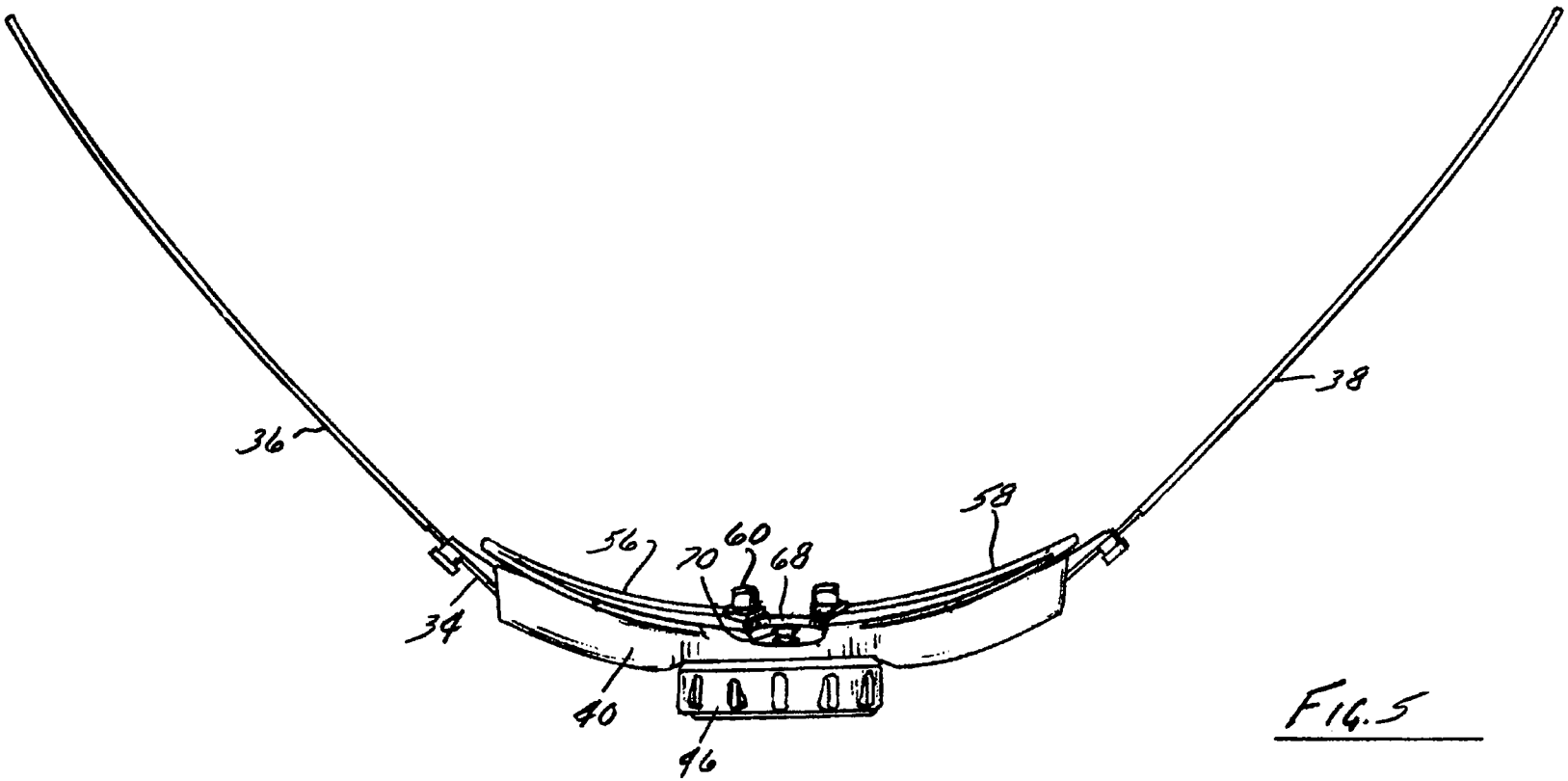
FIG. 5 is a top plan view of the closure assembly shown in FIG. 2.

As shown in FIGS. 3 and 4, supports 56, 58 extend in a generally upward and slightly forward direction relative to handle 46 of closure assembly 20 and, as shown in FIGS. 4 and 5, arms 36, 38 a flexible member 34 extend in a generally forward and lateral direction relative to the operating structure of closure assembly 20. Flexible member 34 and supports 56, 58 are preferably constructed of a pliable yet somewhat rigid material so as to generally correspond to the shape of the anatomical features positioned therebehind. It is appreciated that flexible member 34 could be constructed of one or more plastic materials, a reinforced materials, and/or a flexible metallic material such as a cable.

Figure 6:
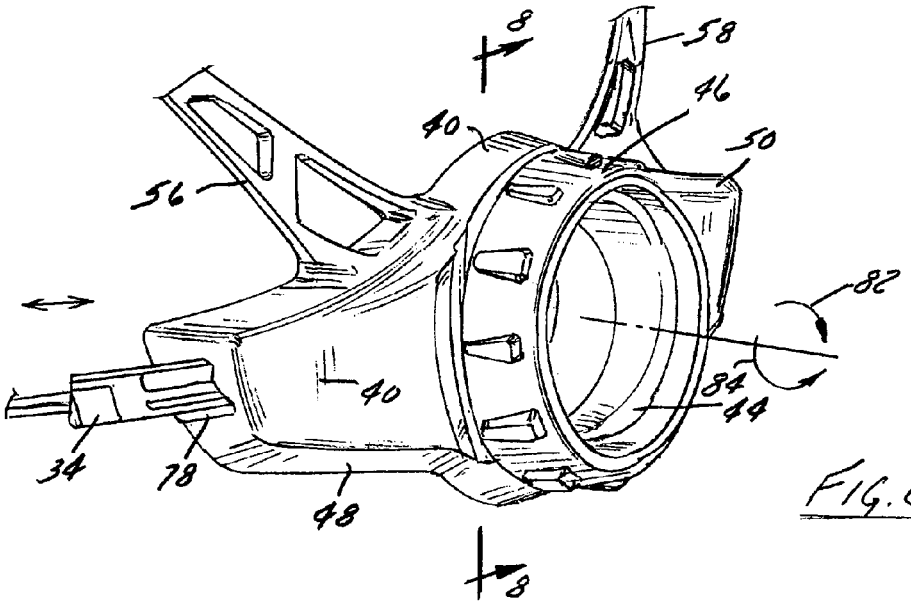
FIG. 6 is a rear perspective detailed view of the closure assembly shown in FIG. 2.

As shown in FIGS. 4 and 6, flexible member 34 is slidably disposed in a passage or channel 78 defined by guides 48, 50 of housing 40. As explained further below, rotational manipulation of handle 46 translates flexible member 34 and an inward and outward direction, indicated by arrow 80, to alter an amount of flexible member 34 that extends beyond housing 40. Said in another way, manipulation of handle 46 dispenses or retracts flexible member 34 relative to housing 40.

As explained further below with respect to FIGS. 7-10, rotation of handle 46 in a first direction, indicated by arrow 82, retracts flexible member 34 relative to housing 40 and rotation of handle 46 in an alternate rotational direction, indicated by arrow 84, allows more of flexible member 34 to extend beyond housing 40 of closure assembly 20. Although closure assembly 20 could be configured to dispense and retract the flexible member 34 in either of the clockwise rotation for one of tightening and loosening and counterclockwise rotation for the other of tightening and loosening of the closure assembly, the rotational direction associated with dispensing and retracting flexible member 34 from housing 40 are preferably associated with clockwise rotation for tightening and counterclockwise rotation for loosening common of such assemblies.

Figure 7:
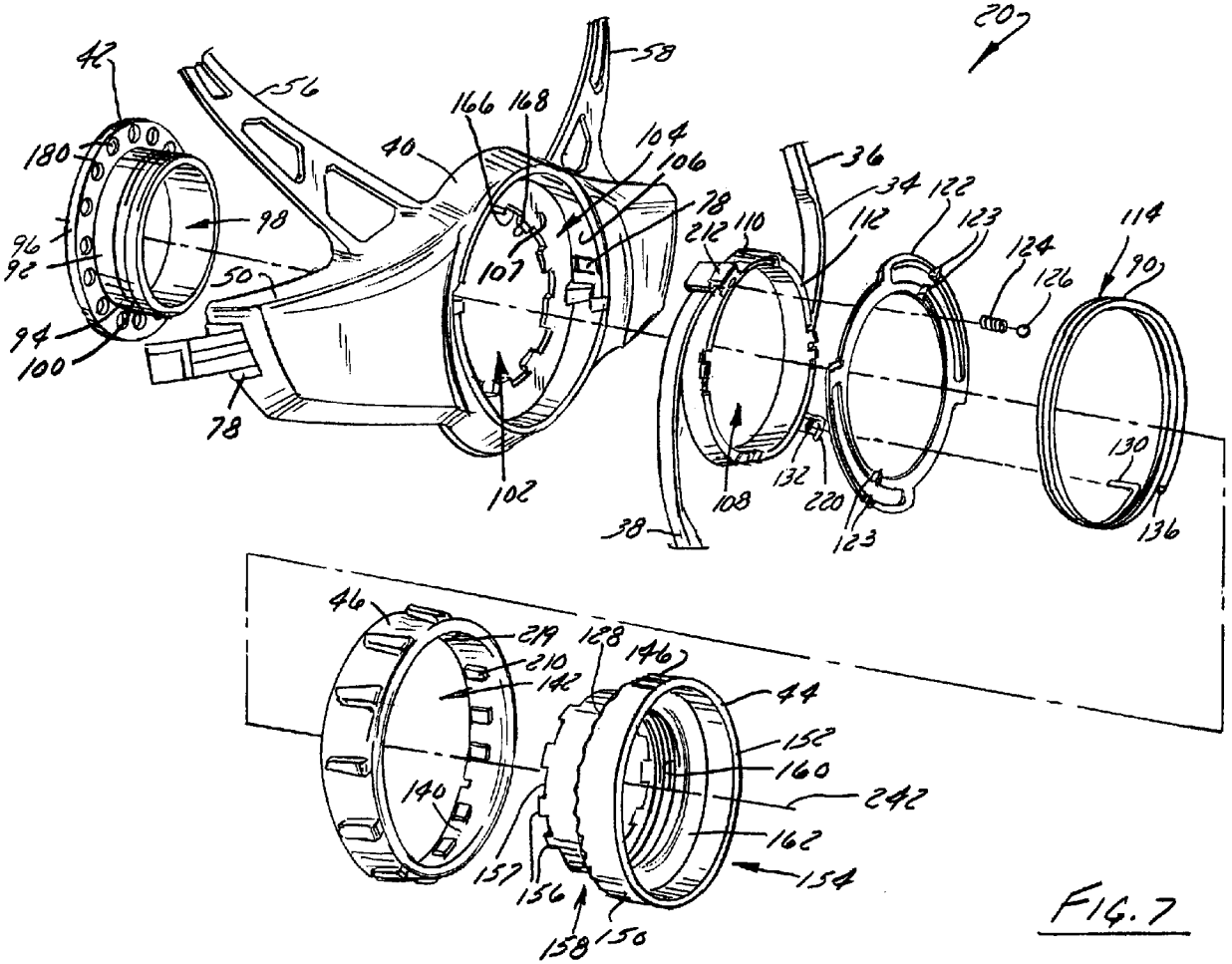
FIG. 7 is an exploded assembly view of the closure assembly shown in FIG. 2.

FIG. 7 is an exploded view of closure assembly 20. Closure assembly 20 includes housing 40, drum 42, flexible member 34, a biasing means, such as a torsion spring 90, handle 46, and drum nut 44. Drum 42 includes a body 92 that includes a stem portion 94 and a flange portion 96. A passage 98 is formed through drum 42 and a threaded surface 100 are formed about a radially outer surface of stem portion 94. Stem portion 94 of drum 42 is constructed to pass through an opening 102 formed through housing 40. Flange portion 96 of drum 42 has a diameter that is larger than opening 102 formed in housing 40 such that a majority of stem portion 94 of drum 42 passes into a chamber 104 of housing 40. Chamber 104 of housing 40 is defined by an upstanding wall 106 and a ledge 107 that extends in a radially outward direction about opening 102. As explained further below, chamber 104 is generally shaped to snuggly and compactly flexible member 34 when closure assembly is assembled.

Flexible member 34 includes an opening 108 at slidably cooperates with the outer surface of stem portion 94 of drum 42 such that a hub portion 110 of flexible member 34 can be positioned in chamber 104. Arms 36, 38 of flexible member 34 are connected to hub portion 110 and extend in a radially outward direction therefrom. Although hub portion 110 and arms 36, 38 of flexible member 34 are shown as having a one-piece construction, it is appreciated that arms 36, 38 could be otherwise attached or secured to hub portion 110 such that rotation of hub portion 110 relative to housing 40 winds or otherwise wraps the arms 36, 38 about the hub portion 110 to alter the length of flexible member that extends beyond housing 40.

Hub portion 110 of flexible member 34 has an abutment face 112 that generally aligns with a lateral end 114 of spring 90 but is wider than the radial width of a cross-section of spring 90. As explained further below with respect to FIGS. 9 and 10, hub portion 110 includes a first tang 212 and a second tang 220 that interfering cooperate with a first projection or tang 210 and a second tang 219 formed on a radially interior surface of handle 46 such that rotational manipulation of handle 46 imparts a rotational manipulation of flexible member 34 relative to housing 40.

Still referring to FIG. 7, closure assembly 20 includes one or more optional indicators such as a clicker disk 122 and/or a spring and ball arrangement 124, 126 that are positioned to cooperate with flexible member 34 and a contoured section defined a number of scallops 128 of drum nut 44 as explained further below. During rotation of handle 46, ball 126 and/or a number of detents 123 formed on clicker disk 122 slidably cooperate with scallops 128 and provide a tactile and/or acoustic indication of movement of flexible member 34 relative to the stationary elements (housing 40, drum 42, and drum nut 44) of closure assembly 20.

Figure 8:
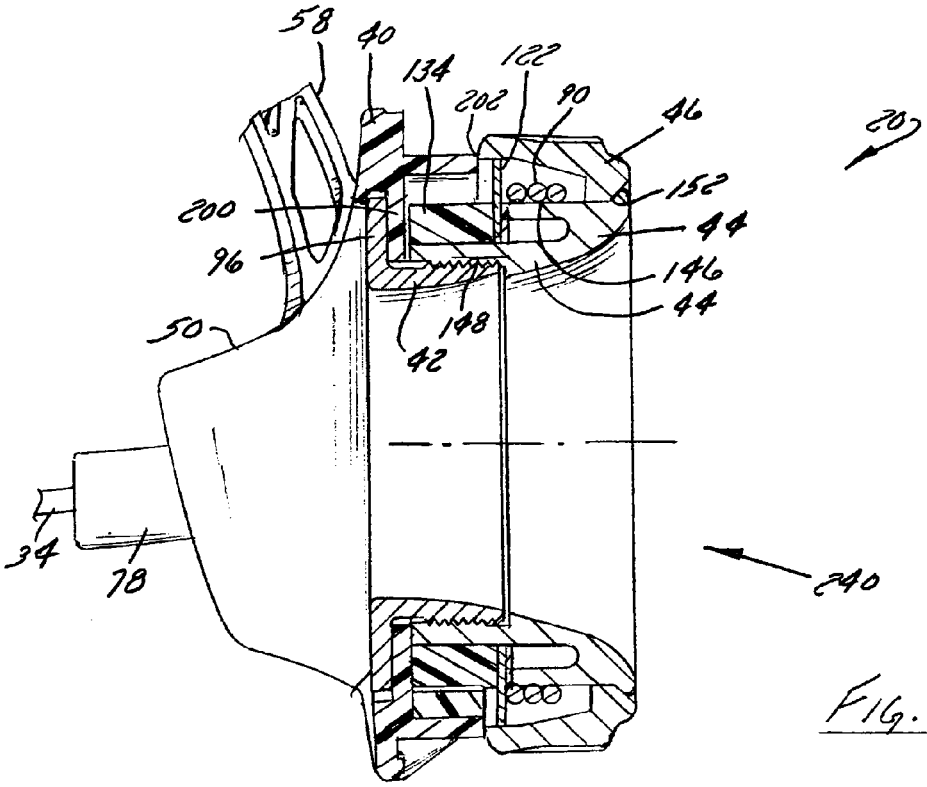
FIG. 8 is a cross-sectional side elevation view of the closure assembly taken along line 8-8 shown in FIG. 6.
Figure 9:
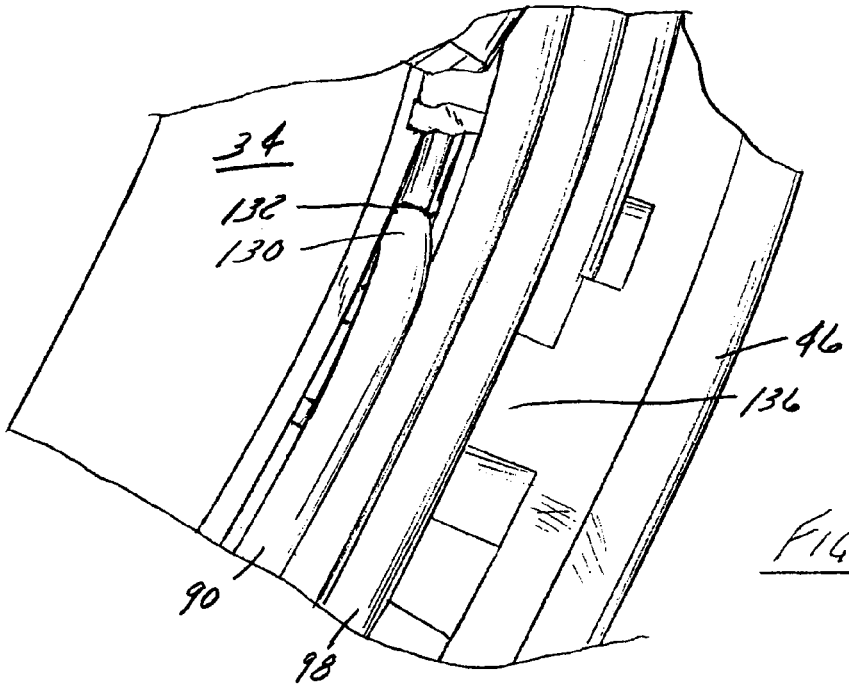
FIG. 9 is a partial sectional view of the closure assembly and shows the mating engagement of an end of a constriction spring and an interfering engagement between a handle and flexible member of the closure assembly shown in FIG. 6.

Referring to FIGS. 7 and 9, spring 90 includes a first end 130 that is constructed to cooperate with a pocket 132 formed in hub portion 110 a flexible member 34. Although the radial shape of spring 90 can be altered as explained further below, cooperation of end 130 of spring 90 with pocket 132 of flexible member 34 fixes the relative positional orientation of spring 90 relative to flexible member 34 of closure assembly 20. As explained further below with respect to FIGS. 8-10, rotational manipulation of handle 46 alters the radius of spring 90 to overcome the securing bias associated with the engagement of spring 90 with drum nut 44.

Still referring to FIG. 7, a second end 136 of spring 90 is constructed to cooperate with one or more projections or tangs 210, 219 formed on radially interior surface 140 of handle 46. Handle 46 includes an opening 142 that is generally greater than a diameter of spring 90 and which is sized to tolerate a radially outward directed flexing of the spring to allow spring 90 to substantially or entirely disengage from frictional constriction about drum nut 44.

Drum nut 44 includes a stepped stem 146 having a first portion 148 and a second portion 150 wherein first portion is constructed to pass radially inward of hub portion 110 of flexible member 34 and second portion 150 is constructed to snuggly and frictionally engage spring 90 when closure assembly 20 is assembled. A lip 152 is formed at a first end 154 of drum nut 44 and a number of teeth 156 and gaps 57 are formed at a second end 158 of drum nut 44. A threaded surface 160 is formed on a radially interior surface 162 of drum nut 44.

Referring to FIGS. 7 and 8, threaded surface 160 of drum nut 44 is constructed to operatively cooperate with threaded surface 100 formed on stem portion 94 of the drum 42. As shown in FIG. 8, when assembled, first portion 148 of drum nut 44 generally underlies flexible member 34 and second portion 150 of drum nut 44 generally underlies spring 90 and handle 46. Also when assembled, teeth 156 and gaps 157 of drum nut 44 interact with the number of channels 166 and corresponding teeth 168 formed by housing 40 so as to generally loosely radially and longitudinally orient and fix the position of drum nut 44 relative to housing 40. When drum 42 and drum nut 44 are threadingly engaged with one another, flexible member 34, one or more of optional indicators disk 122 and/or spring and ball 124, 126, spring 90, and handle 46, are captured between housing 40 and drum nut 44 but rotatable relative thereto.

Flange portion 96 of drum 42 includes a number of optional openings 180 that are configured to cooperate with a spanner wrench or the like to allow rotational tightening of drum 42 and drum nut 44 via the threaded arrangement between threaded surface 100 of drum 42 and threaded surface 160 of drum nut 44. Understandably, it is envisioned that any number of configurations could be provided to facilitate the rotational threaded interaction and tightening between drum 42 and drum nut 44.

As mentioned above and referring to FIGS. 7 and 8, during assembly, hub portion 110 of flexible member 34, optional indicator 122, spring 90, and handle 46 are positioned about the respective portions 148, 150 of drum nut 44. Arms 36, 38 of flexible member 34 are aligned and/or guided through passages or channels 78 defined by housing 40. Teeth 156 of drum nut 44 are aligned and engaged with channels and teeth 166, 168, respectively, of housing 40. Drum 42 is threadingly engaged with drum nut 44 such that flange portion 96 of the drum 42 overlaps a portion 200 of housing 40 and handle 46 is rotationally captured between lip 152 of drum nut 44 and a lip 202 of housing 40. Spring 90 has an at rest configuration that defines a diameter that is slightly less than the diameter of first portion 148 of drum nut 44. Said another way, spring 90 is biased against a torsional force of the spring to be snuggly and frictionally positioned about first portion 148 of drum nut 44 so that spring 90 constricts about the portion of drum nut 44 positioned therebehind.

Figure 10:
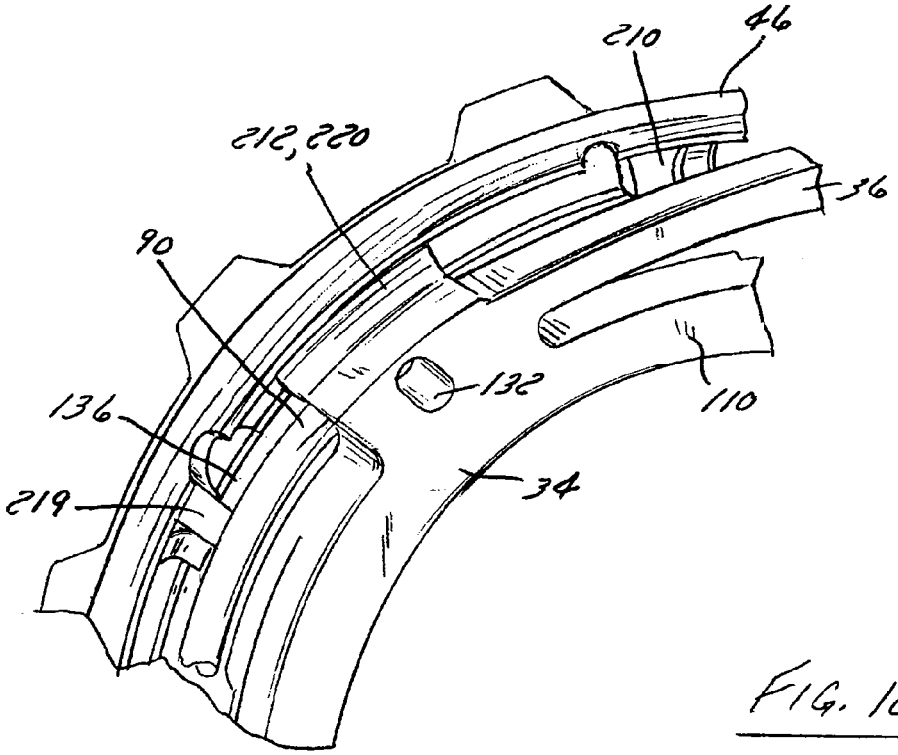
FIG. 10 is a partial sectional view of the closure assembly and shows the interfering engagement with an alternate end of the constriction spring and the flexible member during counterclockwise rotation of the handle of the closure assembly shown in FIG. 6.

Referring to FIGS. 8-10, when assembled, drum 42, drum nut 44, and housing 40 are positionally fixed with respect to one another and are positionally fixed independent of manipulation of handle 46. Rotation of handle 46 relative to housing 40, drum 42, and drum nut 44 causes movement of spring 90 and flexible member 34. When handle 46 is rotated in a clockwise of tightening direction, tang 210 that extends from a radially interior surface of handle 46 interferes with one of a number of tangs 212, 220 that extend from a lateral end of flexible member 34 to effectuate rotation of spring 90 and flexible member 34 in a direction that retracts arms 36, 38 of flexible member 34 into housing 40 but in a direction that corresponds to the constricting bias of spring 90 about drum nut 44. The retraction of arms 36, 38 into housing 40 reduces the cross-sectional area associated with the size of the closure afforded of the item of apparel.

When handle 46 is released, the constricting engagement between spring 90 and drum nut 44 provides a frictional engagement that maintains the orientation of flexible member 34 relative to housing 40 and thereby the shape of the closure opening at a desired tension about the anatomy of the user. Said in another way, rotation of handle 46 in a tightening direction increases the tension associated with flexible member 34 about the wearer.

When handle 46 is rotated in a counterclockwise or loosening direction, second tang 219 of handle 46 interacts with one of tangs 212, 220 of flexible member 34 as well as with end 136 of spring 90. The interaction of tang 219 with end 136 of spring 90 overcomes the constricting bias of spring 90, or "opens" spring 90, so that spring 90 is freely translatable relative to drum nut 44 and flexible member 34 can be rotated so as to dispense or discharge a greater portion of arms 36, 38 beyond housing 40 and thereby increases the cross-sectional opening associated with the closure of the item of apparel so that the item of apparel can be loosened and/or fully removed. Said in another way, rotation of handle 46 in a loosening direction lessens the tension associated with flexible member 34 provided about the anatomy of the wearer.

Regardless of the direction of manipulation of handle 46, when the handle is released, spring 90 constricts about drum nut 44 thereby securing the relative orientation of flexible member 34 relative to housing 40. The interaction of spring 90 with drum nut 44 provides a closure assembly that is infinitely positionable within the operating range of closure assembly 20 as compared to the indexing adjustability associated with the rack and pinion closure assemblies of the prior art. As such, closure assembly 20 provides a highly adjustable closure system that can accommodate a number of different apparel closure applications as well as a large variety of user preferences with respect to any given item of apparel.

Referring back to FIGS. 7 and 8, the radial alignment of openings or passages of the various external members of closure assembly 20 defines a vent passage 240 that is formed along a longitudinal assembly axis, indicated by line 242 in FIG. 7. Vent passage 240 is within the outer perimeter footprint of closure assembly 20 and allows at least some air to pass between the user and the area covered by the closure assembly. Vent passage 240 reduces the detrimental heating affects common to many closure systems wherein the closure system overlaps a continuous area of the user proximate the closure assembly. Accordingly, closure assembly 20 is both convenient to operate and not unduly uncomfortable if worn for extended periods of time and/or during strenuous activities.

Therefore, one embodiment of the invention includes an apparel closure assembly having a housing and a flexible member that extends beyond the housing and engages an item of apparel. A spring is disposed in the housing and an operator is rotatably attached with the housing and engaged by the spring. The operator is configured to interact with the spring and the flexible member so that rotation of the operator in a first direction allows the flexible member to dispense from the housing and rotation of the operator in a second direction retracts the flexible member into the housing. The spring retains the position of the flexible member relative to the housing.

Another embodiment of the invention combinable with one or more of the features or embodiments above includes an adjustable closure assembly having a base member, a drum assembly that extends through the base member, and a handle that is supported by the drum assembly and rotationally connected to the base member. A closure member is disposed between the base member, the drum assembly, and the handle and a spring is positioned between the handle and the drum assembly. The spring is biased from a rest position to constrict about the drum assembly and is positioned to interact with the handle so that rotation of the handle in a first direction biases the spring out of constriction about the drum assembly and rotation of the handle in a second direction rotates the closure member with respect to the base member.

Another embodiment of the invention that is combinable with one or more of the features or embodiments above includes a method of altering a tension of a closure of an item of apparel. A first side of a flexible member is secured to a first side of a closure and a second side of the flexible member is secured to a second side of the closure. Manipulation of a handle alters a tension of the flexible member about the closure and manipulating the shape of a torsion spring in response to manipulation of the handle in a first direction relieves tension of the flexible member and the tension on the flexible member is increased during manipulation of the handle in a second direction opposite the first direction.

Another embodiment of the invention that is combinable with one or more of the features or embodiments above includes an adjustable closure assembly having a housing and a drum that is attached to the housing. A flexible member is supported by the drum and is rotationally positionable relative to the housing. A handle is attached to the drum and positioned to interact with the flexible member to alter a shape of a closure of an item of apparel. A passage is formed through the housing and exposes a portion of a wearer that is within a boundary of the housing to atmosphere.

The present invention has been described above in terms of the preferred embodiment. It is recognized that various alternatives and modifications may be made to these embodiments which are within the scope of the appending claims.

What is claimed is:

1. An apparel closure assembly, comprising:

a housing;

a flexible member that extends beyond the housing and engages an item of apparel;

a spring disposed in the housing;

an operator rotatably attached with the housing and engaged by the spring, the operator being configured to interact with the spring and the flexible member so that rotation of the operator in a first direction allows the flexible member to dispense from the housing and rotation of the operator in a second direction retracts the flexible member into the housing and the spring retains a position of the flexible member relative to the housing; and an unobstructed passage through at least a center of the housing, the flexible member, and the operator.

2. The assembly of claim 1, wherein the spring is a torsion spring that constricts about the operator.

3. The assembly of claim 1, further comprising a drum that cooperates with the housing from a first direction and a drum nut that cooperates with the drum and the housing from a direction opposite the first direction.

4. The assembly of claim 3, wherein the operator is rotationally captured between the housing and the drum nut.

5. The assembly of claim 1, further comprising an indicator that provides at least one of a tactile indication and an acoustic indication of movement of the operator relative to the housing.

6. The assembly of claim 5, wherein the indicator includes a ball that is biased into a detent.

7. An adjustable closure assembly, comprising:

a base member;

a drum assembly that extends through the base member;

a handle supported by the drum assembly and rotationally connected to the base member;

a closure member disposed between the base member, the drum assembly, and the handle;

a spring positioned between the handle and the drum assembly and biased from a rest position to constrict about the drum assembly and positioned to interact with the handle so that rotation of the handle in a first direction biases the spring out of constriction about the drum assembly and rotation of the handle in a second direction rotates the closure member with respect to the base member; and an unobstructed vent formed through a center of the drum assembly and the base member.

8. The assembly of claim 7, wherein the closure member includes a first arm and a second arm that extend in opposite lateral directions from the base member.

9. The assembly of claim 8, wherein the base member includes a first support that underlies the first arm and a second support that underlies the second arm.

10. The assembly of claim 7, wherein the base member includes a helmet support that offsets an axis of rotation of the handle from a rear lower edge a helmet.

11. The assembly of claim 7, wherein an axis of the vent is concentric with an axis of rotation of the handle.

12. The assembly of claim 7, wherein the drum assembly includes a drum that passes through the base member and a drum nut that rotationally engages the drum.

13. The assembly of claim 12, wherein the drum nut includes a number of teeth that cooperate with a number of channels formed in the base member.

14. The assembly of claim 7, further comprising an indicator that provides an indication of movement of the handle relative to the base member.

15. The assembly of claim 14, wherein the indicator is at least one of a tactile indicator and an acoustic indicator.

16. An adjustable closure assembly, comprising:

a housing;

a drum attached to the housing;

a flexible member supported by the drum and rotationally positionable relative to the housing;

a handle attached to the drum and positioned to interact with the flexible member to alter a shape of a closure of an item of apparel; and an unobstructed passage formed through at least a center of the housing that is configured to expose a portion of a wearer that is within a boundary of the housing to atmosphere.

17. The assembly of claim 16, further comprising a spring that maintains an orientation of the flexible member relative to the housing.

18. The assembly of claim 17, wherein the spring constricts about the drum and rotation of the handle in a first direction overcomes constriction of the spring about the drum.

* * * * *